United States Patent [19]

Puerner

[11] 3,965,454

[45] June 22, 1976

[54] MEANS LOWERING CONTACT RESISTANCE IN VARIABLE RESISTANCE CONTROL

[75] Inventor: George O. Puerner, Frankfort, Ind.

[73] Assignee: P. R. Mallory & Co., Inc., Indianapolis, Ind.

[22] Filed: Sept. 12, 1974

[21] Appl. No.: 505,508

[52] U.S. Cl. ..... 338/174; 338/171; 338/176; 338/211; H01C/10/38

[51] Int. Cl.[2] ..... H01C 10/32

[58] Field of Search ..... 338/139, 140, 141, 142, 338/171, 174, 176, 202, 211, 217; 219/522, 543

[56] References Cited

UNITED STATES PATENTS

| | | | |
|---|---|---|---|
| 1,985,166 | 12/1934 | Haroldson | 338/138 |
| 1,992,410 | 2/1935 | Benkelman | 338/217 |
| 2,005,922 | 6/1935 | Stoekle | 338/140 |
| 2,134,870 | 11/1938 | Fruth | 338/142 |
| 2,632,830 | 3/1953 | Aust et al. | 338/174 X |
| 2,710,900 | 6/1955 | Linder | 338/217 X |
| 3,343,115 | 9/1967 | Greenwood | 338/174 |
| 3,855,565 | 12/1974 | Robinson et al. | 338/171 |

*Primary Examiner*—C. L. Albritton
*Attorney, Agent, or Firm*—Hoffmann, Meyer & Hanson

[57] ABSTRACT

An electrical contact arm having an electrical contact engaging a collector path also has at least two electrical contacts engaging a resistance path, the resistance path having rows of discrete spots of a good electrically conductive material spaced along the resistance path, the number of rows being equal to the number of electrical contacts engaging the resistance path, and the spots of one row being staggered with respect to the spots of another row such that at least one of the electrical contacts engaging the resistance path will be in engagement with one of the spots as the contact arm moves along the collector and resistance paths.

6 Claims, 2 Drawing Figures

MEANS LOWERING CONTACT RESISTANCE IN VARIABLE RESISTANCE CONTROL

Figure 1:
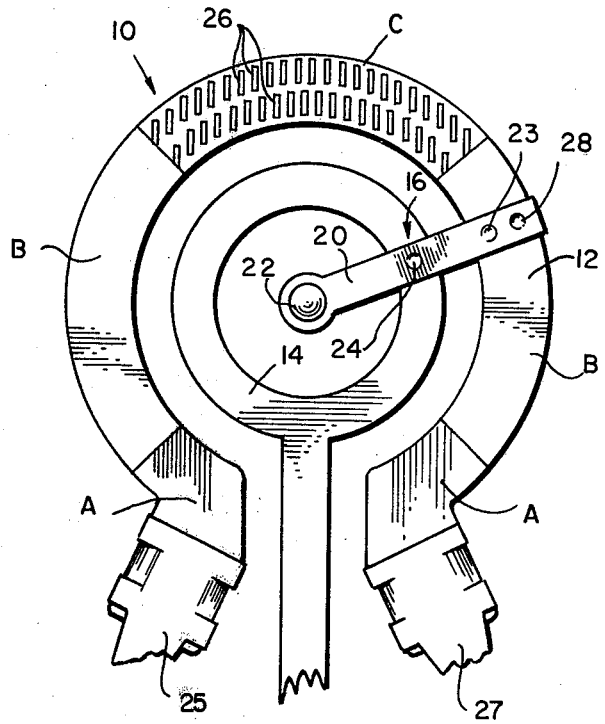

Generally speaking the present invention relates to variable resistance control having a collector path and a resistance path having at least two areas of different resistance values and movable electrical contact means bridging the paths, wherein discrete spots of a good electrically conductive material are provided on an area of a higher resistance value and the electrical contact means includes at least two electrical contact elements engaging the resistance path, whereby there is at least one of the contact elements contacting one of the spots as the electrical contact means is moved over the paths.

Variable resistance controls are used in appliances such as televisions and stereos to vary their sound output. In steros, the volume of sound for the separate speakers is controlled by varying the electrical resistance to the individual speakers. The volume of output of an individual speaker in steros, however, needs to be capable of being balanced by balance controls with respect to other speakers in accordance with the desires of the listener. In such circumstances the variable resistance control must be sufficiently sensitive to adjust the volumes of the speakers without causing imbalance or "cross talk" from one speaker to the other. This becomes an especially difficult problem when high resistance values are required, for example at about 10,000 ohms and more. More specifically, it has been found that due to the high contact resistance; that is, the resistance between the resistance path and the contact engaging the path, cross talk between the speakers occurs. The present invention overcomes this problem by slightly reducing the contact resistance in proportion to the overall resistance in those areas where the resistance path is sufficiently high in value to readily cause an imbalance.

Figure 2:
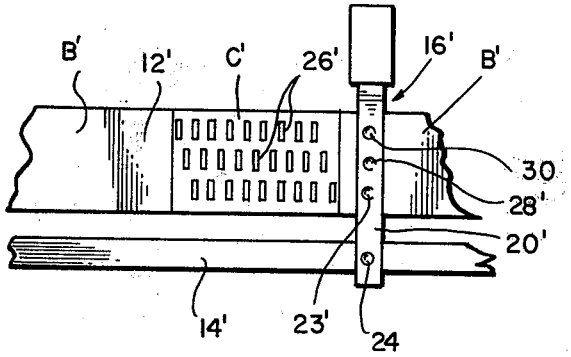

Accordingly, it is a feature of the invention to provide a variable resistance control having a means to reduce contact resistance in those areas of a resistance path having a relatively high resistance values. Another feature of the invention is the provision of a variable resistance control wherein a resistance path includes discrete spots of a good electrically conductive material dispersed along the path. Another feature of the invention is the provision of such a variable resistance control wherein there are two electrical contact elements engaging the resistance path. Still another feature of the invention is to provide such a variable resistance control wherein the resistance path is circular and there are two rows of spots, the spots being alternately spaced from one another. Still another feature of the invention is the provision of such a variable resistance control wherein the resistance path is lineal, there are three rows of spots, the spots being alternately spaced from one another, and there are three electrical contact elements engaging the resistance path. These and other features of the invention will become apparent from the following description taken in conjunction with the accompanying drawings wherein:

FIG. 1 is a plan view, partially in schematic, of a circular variable resistor showing the features of the invention; and FIG. 2 is a plan view, partially in schematic, of a lineal variable resistor showing the features of the invention.

Referring to the drawings, and particularly FIG. 1, there is shown a variable resistor control 10 which in general includes a resistance path 12, a collector path 14, electrical terminals 25 and 27 connected to the resistance path, and an electrical contact means 16 electrically bridging the resistance path and the collector path. Electrical contact means 16 includes an arm 20 connected to a rotatable shaft 22, the arm having three electrical contact elements 24, 23, and 28 (such as dimples or fingers extending from the arm) engaging their respective paths to electrically bridge the resistance path with the collector path. Resistance path 12, in the illustrative embodiment, is divided into areas of different resistive values. Area A is of low resistance, area B of a higher resistance value, and area C the highest resistance value. Such different values can be achieved by the application of a carbon paint on a suitable substrate such as a plastic, of varying carbon concentration, the higher the concentration the lower the resistance value.

The variable resistor control described thus far is well known in the art and thus is not described in detail. For example the resistance and collector paths 12 and 14 would be carried by a terminal board. And the whole unit would be carried in a housing, with the electrical terminals (including one for the collector path) extending outside the housing.

As shown in the illustrative embodiment, the resistance values of one half the resistance path is the same as the resistance values of the other half. This arrangement is particularly adaptable to balance control in steros wherein separate speakers are used. That is, depending upon which side of the control the electrical contact means is operating, a different speaker will be controlled. In such applications, it has been found that imbalance of the stereo speakers occurs quite readily when adjustments are being made through movement of the electrical contact means 16 in the high resistance area C. According to the present invention, this problem has been overcome by providing a means to lower the contact resistance of the electrical contact means in the high resistance value area. More specifically, according to the present invention, there is provided a multiplicity of discrete spots 26 of an electrically conductive material such as silver or copper dispersed throughout the resistance path, the spots being exposed to the outer surface of the resistance so that they can be engaged by the contact elements 23 or 28 as the elements move through the high resistance area. As shown the spots are generally rectangular in shape, spaced in two rows, the spots being alternately spaced from each other. One method of applying the spots would be by applying a silver paint through a screen, for example.

In operation, the operator turns shaft 22 through a knob (not shown) which rotates contact arm 20 to vary the resistance as the elements 23 and 28 rotate about resistance path 12. Within the area C, the spots 26 are arranged such that one of the elements 23 or 28 will always be engaged with one of the spots as they pass through the area. It has been found that this will reduce the contact resistance sufficiently to permit balancing the output of the speakers.

FIG. 2 schematically depicts another embodiment of the invention. In this embodiment the collector path 14' and resistance path 12' are lineal for operation in a lineal potentiometer type variable resistance control. The collector and resistance paths are electrically bridged by an electrical contact means 16' which in general includes a contact arm 20' carrying contact elements 24', 23', 28' and 30, there being one more element for the resistance path than in the embodiment of FIG. 1. There are three rows of spots 26' in the high resistance area C, the spots being alternately spaced. Contact arm 20' is moved lineally along the collector and resistance paths, at least one of the elements 23', 28' or 30 engaging one of the spots 26' discreetly dispersed along the resistance path.

What is claimed is:

1. A variable resistance control comprising:

a. an electrically insulative substrate, b. a resistance path and a collector path carried on said substrate, c. a movable electrical contact arm having an electrical contact engaging said collector path, and at least two electrical contacts engaging said resistance path, d. electrical terminals electrically connected to said collector and resistance paths, and e. rows of discrete spots of a good electrically conductive material spaced along said resistance path, the number of rows being equal to the number of electrical contacts engaging said resistance path, and the spots of one row being staggered with respect to the spots of another row such that at least one of the electrical contacts engaging said resistance path will be in engagement with one of said spots as said contact arm moves along said collector and resistance paths.

2. In a variable resistance control according to claim 1 wherein said electrically conductive spots are silver.

3. In a variable resistance control according to claim 1 wherein said paths are circular.

4. In a variable resistance control according to claim 1, wherein said spots are rectangular.

5. In a variable resistance control according to claim 1 wherein said paths are lineal.

6. In a variable resistance control according to claim 1 wherein there are three rows of said spots, alternately spaced from one another, and wherein there are three of said contact elements.

* * * * *